PTU34 XR 4,063,847

United States Patent [19]

Simmons

[11] 4,063,847

[45] Dec. 20, 1977

[54] GAS TURBINE ENGINE CASING

[75] Inventor: Roy Simmons, Olveston, England

[73] Assignee: Rolls-Royce (1971) Limited, United Kingdom

[21] Appl. No.: 603,606

[22] Filed: Aug. 11, 1975

[30] Foreign Application Priority Data

Aug. 23, 1974 United Kingdom ..... 37041/74

[51] Int. Cl.[2] ..... F04D 29/44

[52] U.S. Cl. ..... 415/200; 415/214; 415/219 R

[58] Field of Search ..... 415/214, 216, 217, 218, 415/219 R; 416/241 A

[56] References Cited

U.S. PATENT DOCUMENTS

| | | | |
|---|---|---|---|
| 2,834,537 | 5/1958 | Neary | 415/217 |
| 2,995,294 | 8/1961 | Warnken | 415/217 |
| 3,052,431 | 9/1962 | Compton | 415/214 |
| 3,279,967 | 10/1966 | Martin, Jr. et al. | 416/241 A |
| 3,291,382 | 12/1966 | Blackhurst et al. | 415/217 |
| 3,393,436 | 7/1968 | Blackhurst et al. | 415/218 |
| 3,494,539 | 2/1970 | Littleford | 415/214 |
| 3,514,238 | 5/1970 | Smith | 415/214 |
| 3,556,675 | 1/1971 | Howalol et al. | 415/214 |
| 3,813,185 | 5/1974 | Bouiller et al. | 415/217 |
| 3,876,327 | 4/1975 | Lobanoff | 415/200 |

FOREIGN PATENT DOCUMENTS

| | | | |
|---|---|---|---|
| 888,299 | 8/1953 | Germany | 415/217 |

*Primary Examiner*—C. J. Husar

*Attorney, Agent, or Firm*—Stevens, Davis, Miller & Mosher

[57] ABSTRACT

A composite casing for a gas turbine engine comprises an inner wall which may be an integrally formed drum or a plurality of separate rings, and which is overwound with carbon fibers in a cross-weave and resin bonded to the inner wall. Honeycomb material is used to increase the outside diameter of the inner wall to provide continuous surface over which to wind the fibers.

5 Claims, 7 Drawing Figures

GAS TURBINE ENGINE CASING

The present invention relates to gas turbine engine casings and has particular but not exclusive reference to compressor casings.

It is an object of the invention to provide a relatively light-weight composite casing structure.

According to the present invention a gas turbine engine casing comprises an annular inner wall which includes axially alternate stator vane retaining portions and rotor blade tip surrounding portions and which is surrounded by an outer layer of a carbon fiber reinforced composite material comprising continuous carbon fibers wound around the inner wall and embedded in a resin matrix which bonds the fibers to the wall.

The stator vane retaining portions and rotor blade surrounding portions may be made from a metal or composite fiber reinforced material, and preferably the lightest materials compatible with the strength and temperature requirements of the casing are used.

The stator vane retaining portions and rotor blade surrounding portions may be in the form of separate rings or may be parts of a complete casing wall which may be wholly metallic, wholly made from fiber-reinforced composite material, or may be a combination of both.

In order to provide a smooth outer surface for winding the carbon fibers recesses in the outer surface of the inner wall are preferably filled with a lightweight material, for example, honeycomb or a fiber reinforced composite material.

A feature of the invention also provides a method of making a composite casing for a gas turbine engine comprising the steps of locating stator-retaining inserts in axially spaced apart relationship with spacers therebetween, and over-winding the inserts and spacers with continuous filaments of resin coated fibers around the outside to bind the inserts and spacers into a unitary structure.

The invention will now be more particularly described with reference to the accompanying drawings in which.

Figure 1:
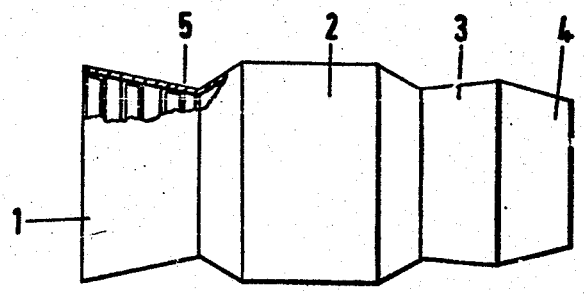
FIG. 1 is a diagrammatic representation of a gas turbine engine incorporating a compressor casing according to the invention.

Referring now to the drawings in FIG. 1 there is shown a gas turbine engine comprising in flow series, a compressor 1, combustion equipment 2, a turbine 3 and an exhaust nozzle 4, all of which may be of a form well known in the gas turbine engine field.

Figure 2A:
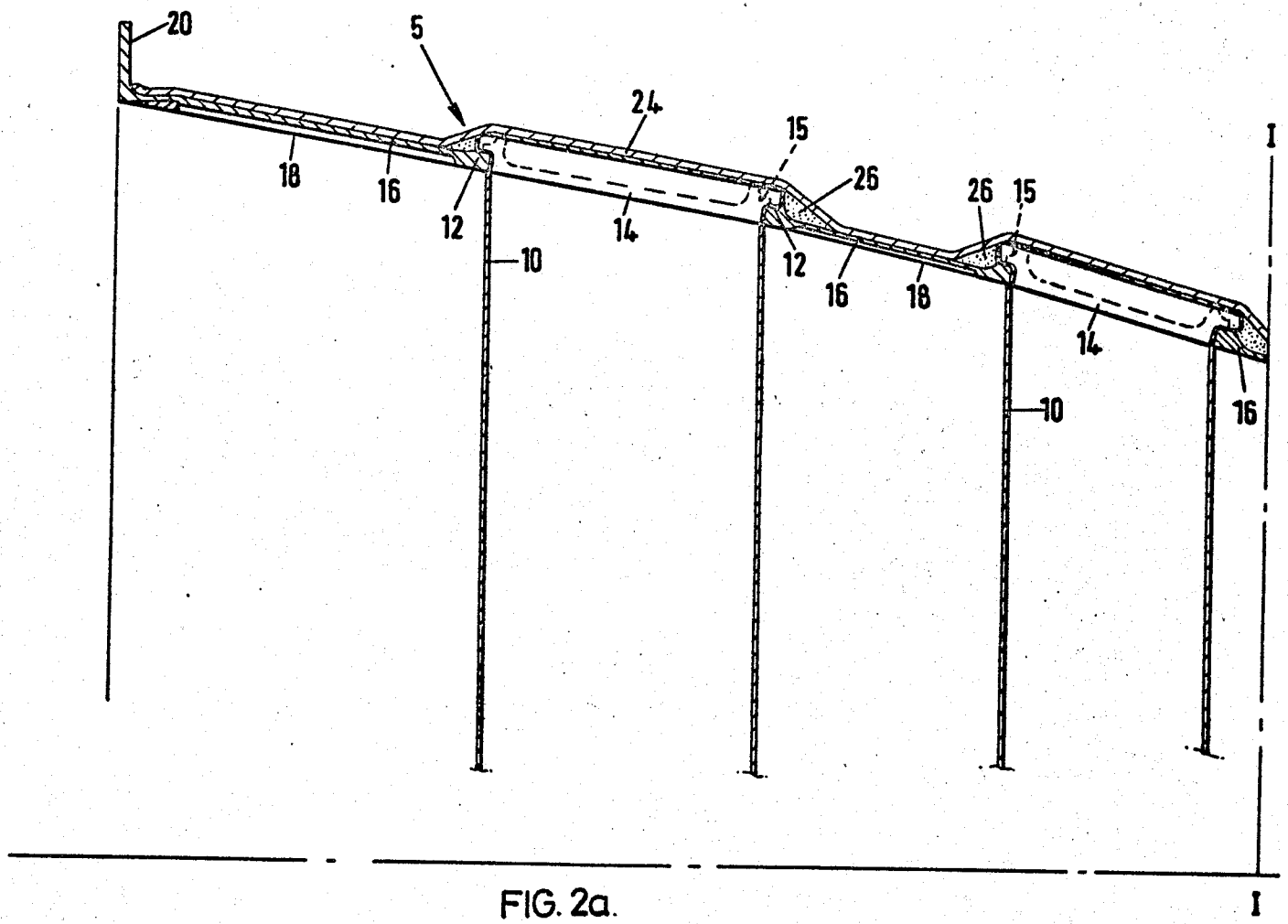
FIG. 2 is a composite enlarged sectional elevation of the compressor casing of FIG. 1 and divided on the line I — I into parts FIG. 2*a* of FIG. 2*b*
Figure 2B:
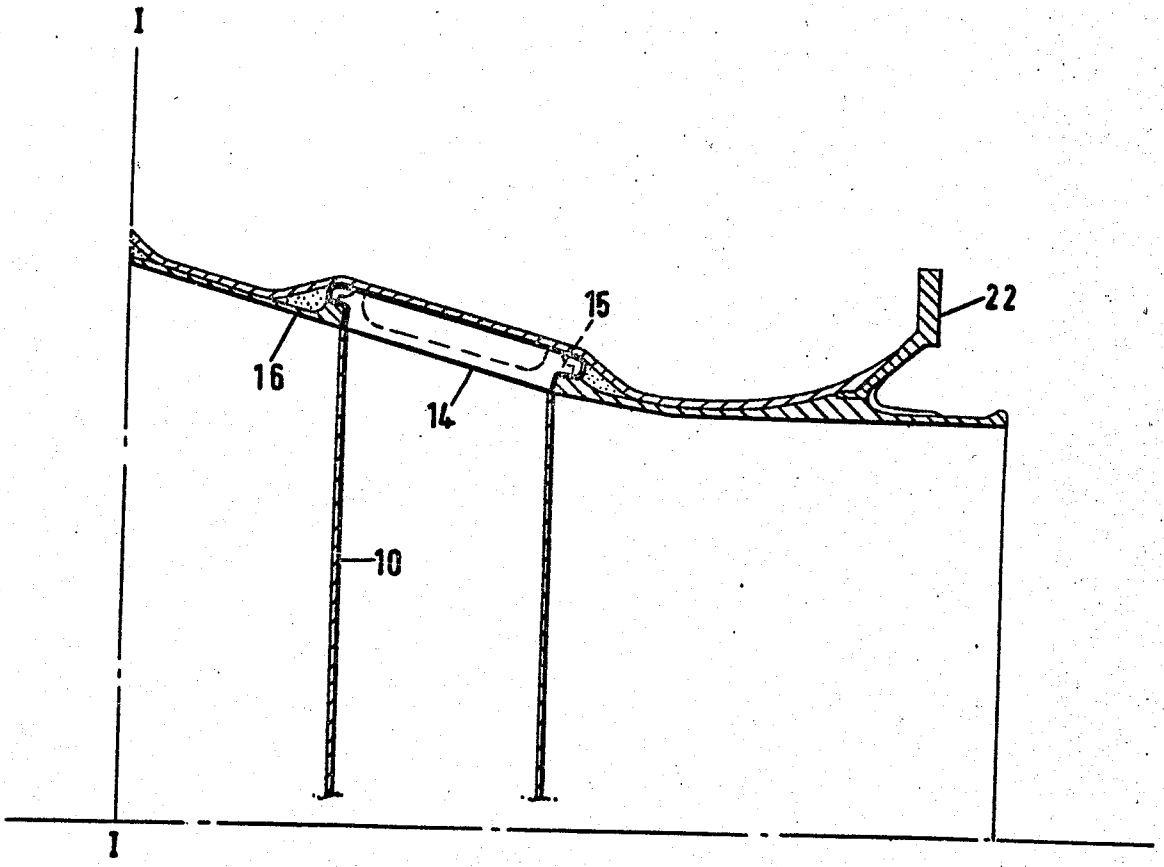

The compressor 1 has an outer casing 5 which is shown in greater detail in FIG. 2, and which consists of a plurality of alternate stator-retaining rings 10 and spacer rings 16 of different materials which form an inner wall, and which are overwound with an outer layer 24 of resin-bonded carbon fibers which bonds the rings into a unitary structure.

Referring now to FIG. 2 the inner wall of the compressor casing 5 includes three axially spaced apart stator vane retaining rings 10 made from rolled steel, and which are in the form of continuous circumferentially extending Tee-section rings having axial arms 12. The arms 12 of the Tee-section ring define undercut recesses 15 suitable for receiving the roots of stator vanes 14 which are indicated in dotted lines.

Between the rings 10 are disposed spacer rings 16 which serve to locate the rings 10 at the appropriate axial distance apart, and also to form a smooth internal wall for the passage of air through the compressor, the spacers forming a continuation of the usual platform (not shown) of the stator vanes 14. The spacer rings surround the tips of rotor blades of the compressor rotor in the completed construction and can be shaped as at 18 to provide a recess for an abradable lining on the compressor wall.

The spacer rings are retained against radial movement by being fitted radially inwardly of and abutting the arms 12 of the Tee-section rings 10.

Since the spacer rings are not highly stressed components, they are made from a lightweight carbon fiber reinforced plastic material.

In order to build up the compressor casing, the rings 10 and spacer rings 16 are located on a mandrel in a jig along with front and rear end flanges 20 and 22, and then a continuous filament of carbon fiber is wound over the outside of the whole assembly in a cross weave, and at the same time resin is applied to the carbon fiber. When the resin is cured the carbon fibers form an outer layer 24 which binds the assembly together and the whole assembly can be removed from the jig as a unitary structure. The fiber filament is in fact a bundle of smaller filaments known as a tow.

In order to prevent overstressing the fibers by winding them into tight corners and over small radii, sufficient filler material is added around the outside of the spacer rings to round off at least any sharp radii, for example, with corner fillets as shown at 26 prior to winding. These corner fillets may be themselves made from composite fiber reinforced resin material. Alternatively the spacers themselves may be shaped to avoid sharp radii. As a further alternative the whole of the outer surface of the smaller diameter spacer rings may be built up with a lightweight filler material to the same outer diameter as the stator vane retaining rings to provide a smooth outer surface on which the carbon fibers may be wound.

The stator vanes are inserted into the Tee-section rings through a single cut-out in each ring through which the roots of the stator vanes are passed one after the other and the roots are then moved circumferentially around the slot.

When each row of stator vanes is full the last stator vane root is held in position in the slot by four bolts which pass through the casing from the outside and screw into the stator vane root.

In order to assemble the whole compressor including the rotating blade rows, a rotor disc complete with blades is added after each stator vane row is completed.

The materials of the components of the casing described above may be varied in accordance with the requirements of the casing design. The rolled steel of the stator vane retaining inserts may be changed, for example, to aluminum or magnesium alloy for the cool end of a compressor or to titanium or nickel alloys for hot end applications. If the stator vanes themselves are made from carbon fibers it may be possible to use preformed carbon fiber rings and thus produce a homogeneous compressor design.

Similarly the lightly stressed spacer rings may be made from glass or carbon fibers or again from a lightweight metal alloy.

It is expected that a carbon fiber layer of the order of 0.050 in. will be sufficiently strong and rigid for a low pressure compressor of a gas turbine engine.

Figure 4:
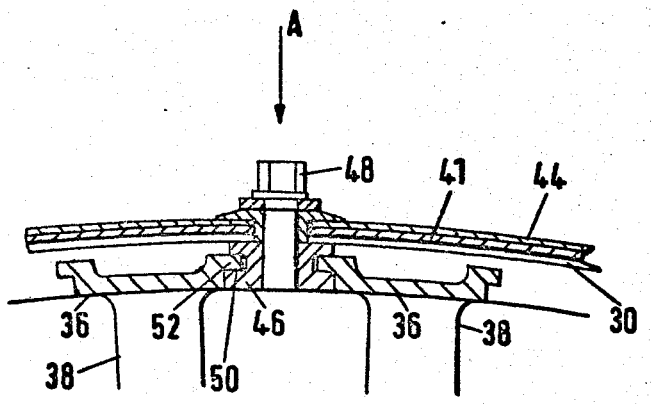
FIG. 4 is a section on the line IV — IV of FIG. 3, and, FIG. 5 is a view on the arrow A of the stator retaining insert shown in FIG. 4.
Figure 5:
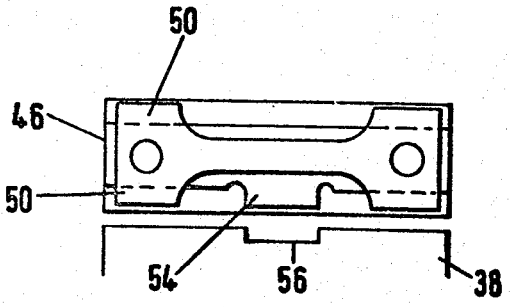
Figures 3, 3A:
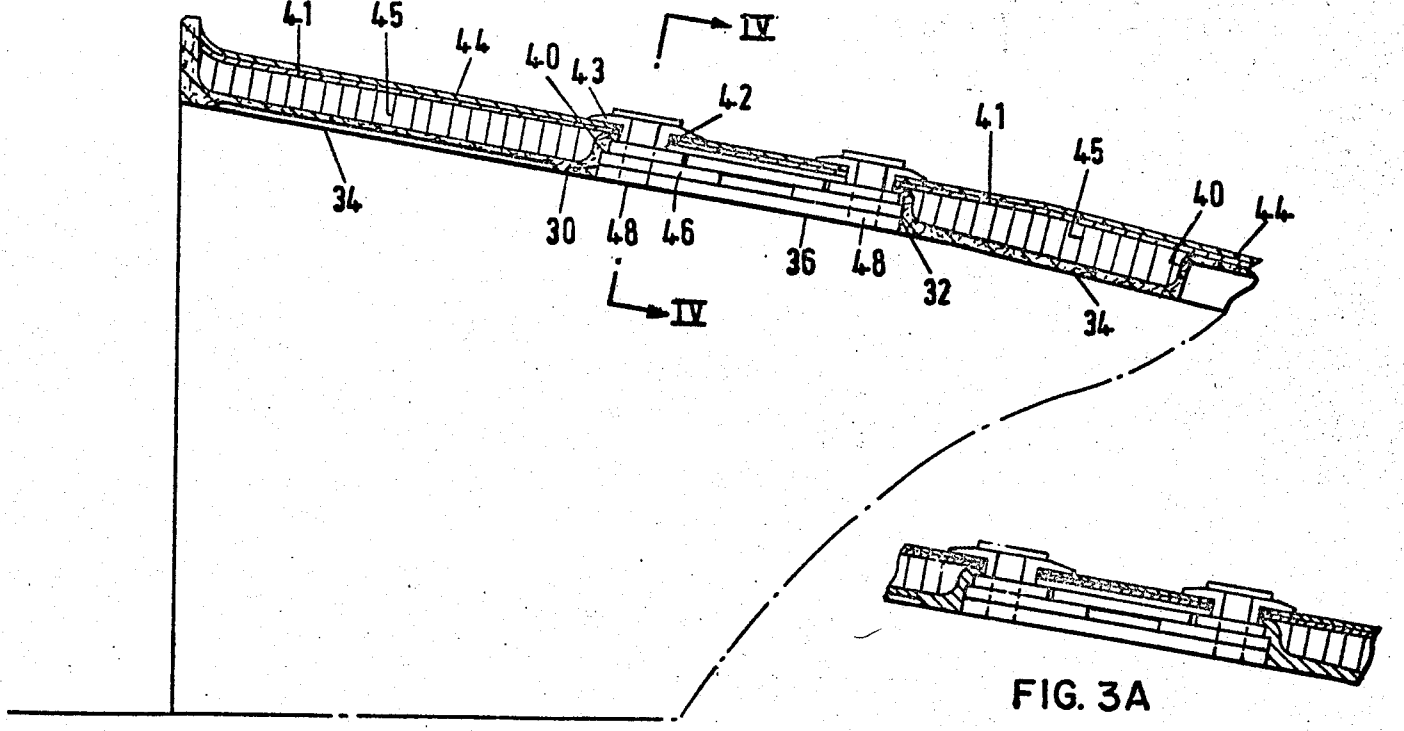
FIG. 3 is an enlarged sectional elevation of the front portion only of an alternative casing construction.
FIG. 3*a* is a fragment of FIG. 3 to show the construction when metal is used instead of glass fiber reinforced composite material.

An alternative construction of compressor casing is illustrated in FIGS. 3 to 5. In this construction the inner wall of the casing is formed as a single drum which may be of metal 30*a* or a glass fiber reinforced composite material 30.

In the example illustrated a glass fiber reinforced drum 30 provides the inner wall and defines stator vane-receiving recesses 32 and rotor blade-surrounding portions 34 which define a smooth gas flow passage with platform portions 36 of the stator vanes 38. The drum may be filament wound from glass fiber or made by laying up strips of pre-impregnated fibers molded into shape, but in either case the drum is formed as a complete drum so that there are no joints to be made.

The drum is formed alternately with axially spaced apart portions of relatively smaller and larger diameters respectively, which define alternately outwardly and inwardly facing recesses 40 and 32. The inwardly facing recesses 32 contain the stator vanes, but the outwardly facing recesses 40 provide a problem with the winding of the carbon fiber layer.

The problem is solved in this constructional example by filling the recesses 40 with a lightweight honeycomb material 45 to provide a smooth surface onto which the carbon fibers 41 may be wound.

Provision of holes and bosses for the attachment of the stator vanes is achieved by winding around pegs positioned in the casing so as to leave the holes 42 clear, and the fiber build up around the holes is subsequently compressed with a load spreading washer 43 to provide a boss.

A further layer of glass fibers, 44, may be provided around the rotor blade positions as a blade containment feature.

The stator vanes are held in position in the recesses 32 by metallic retaining plates 46 which are bolted to the casing by bolts 48.

The retaining plates are metallic and are provided with axially extending slots 50 in their circumferential side edges in which flanges 52 on the stator vanes are retained against circumferential movement. Axial movement of the stator vanes is prevented by a tongue 54 on the plate which mates with a slot 56 on the stator vane. Thus metal to metal contact is provided for restraining axial movement of metal vanes rather than placing reliance on the composite material of the shoulders of the recess 32 which would be less resistant to frettage.

FIG. 3*a* shows the construction of FIGS. 3 to 5 when the metal drum 30*a* is used instead of the glass fiber reinforced drum 30.

The method of assembly of the compressor is as follows:

Since the recesses 32 are straight-sided at their axial ends a retaining plate is bolted into position and a vane can be inserted into the recess and moved circumferentially around to engage its flange 52 in a groove 50 in the plate. The next plate can then be inserted into the recess and moved round circumferentially to abut the vane and the row of alternate vanes and plates is built up in this way. There is sufficient clearance allowed in the grooves 50 between the plates and vanes in the circumferential direction that, provided the plates are not bolted in initially, the cumulative clearance will allow the last plate to be inserted. All the plates and vanes are then moved back circumferentially to spread the cumulative clearance equally between all adjacent flanges and slots, and the plates are then bolted in position.

A compressor casing constructed in the above-described manner is sinificantly lighter than conventional metal or composite material casings due to the great strength of the carbon fibers and their use in a continuous woven layer to provide the hoop strength necessary in the compressor casing.

Due to the very high modulus of elasticity of the carbon fibers the rigidity of the composite casing as described above is increased compared to a glass fiber-reinforced casing of the same thickness, and in fact the rigidity of the modified casing described with reference to FIGS. 3 to 5 is further enhanced by the interposition of the honeycomb layer between the inner wall and the carbon-fiber skin.

The pattern of the winding can be varied to optimize the directions and number of turns of the fibers at any location of the casing for varying stresses in the casing.

At the downstream end of the casing the wound fibers are spread out to form a radial flange and this is reinforced with further windings or tapes of fiber reinforced material.

A further alternative casing may be constructed using a thin inner casing or shell or metal, rolled and welded to form a drum but using the directionally wound carbon fiber outer layer as the main structural member.

I claim:

1. A gas turbine engine compressor comprising in combination a hollow drum of circular cross-section and a plurality of rows of radially inwardly extending stator vanes disposed in annular recesses formed in the drum and wherein the drum comprises:

an inner wall of fiber-reinforced composite material, said inner wall having axially successive portions of relatively smaller and larger diameters respectively thereby defining a plurality of alternately radially inwardly facing and radially outwardly facing annular recesses, the radially inwardly facing recesses defining means for receiving said stator vanes, an intermediate layer of relatively lightweight filler material extending over the outer surface of said inner wall at least in the region of the radially outwardly facing recesses thereof, said intermediate layer at least partially filling the recesses and thereby eliminating sharp changes in diameter of said outer surface, and a second wall comprising carbon fiber material continuously wound around said inner wall and said intermediate layer.

2. A gas turbine engine compressor according to claim 1 wherein said filler material is a lightweight honeycomb material of sufficient thickness in the radially outwardly facing recesses that its outer surface provides a continuation of the outer surface of the adjacent stator vane receiving portions of the drum.

3. A gas turbine engine compressor according to claim 1 in which a further layer of composite fiber reinforced material is provided around the drum at least in the area of the radially outwardly facing recesses of said inner wall as a blade containment feature.

4. A gas turbine engine compressor according to claim 1 which further comprises means for mounting said stator vanes in the radially inwardly facing recesses of said inner walls, said mounting means having flanges on the circumferential side edges thereof; retaining plates for positioning said stator vanes, said plates having slots along their circumferential side edges in which the flanges on said mounting means are disposed; and bolts securing said retaining plates to said hollow drum.

5. A gas turbine engine compressor according to claim 1 wherein the inwardly facing recesses of said inner wall are formed with undercut portions and wherein said stator vanes have correspondingly shaped projections on the radially outer portions thereof for mounting said stator vanes within said hollow drum.

* * * * *